US007895962B2

(12) United States Patent
McLean et al.

(10) Patent No.: US 7,895,962 B2
(45) Date of Patent: Mar. 1, 2011

(54) SECTIONAL BOAT

(76) Inventors: Daniel Harold McLean, Farmington (CA); Edwin Olimanns, Farmington (CA)

( * ) Notice: Subject to any disclaimer, the term of this patent is extended or adjusted under 35 U.S.C. 154(b) by 158 days.

(21) Appl. No.: 12/230,980

(22) Filed: Sep. 9, 2008

(65) Prior Publication Data

US 2010/0058970 A1 Mar. 11, 2010

(51) Int. Cl.
*B63B 7/04* (2006.01)

(52) U.S. Cl. ..... 114/352

(58) Field of Classification Search ..... 114/343, 114/352, 355

See application file for complete search history.

(56) References Cited

U.S. PATENT DOCUMENTS

| | | | |
|---|---|---|---|
| 3,594,834 | A | 7/1971 | Steensen |
| 3,744,071 | A | 7/1973 | Bossler, Jr. |
| 3,916,468 | A | 11/1975 | Tetreault et al. |
| 3,965,513 | A | 6/1976 | Horiuchi |
| 4,366,769 | A | 1/1983 | Lingeman |
| 4,478,167 | A | 10/1984 | Hart |
| 4,693,203 | A | 9/1987 | Lewis |
| 4,718,587 | A | 1/1988 | Roberts |
| D297,134 | S | 8/1988 | Levine |
| 4,794,876 | A | 1/1989 | Levine |
| D305,636 | S | 1/1990 | Kienlen |
| 5,261,346 | A | 11/1993 | Updyke |
| 5,301,629 | A | 4/1994 | Kleyh et al. |
| 5,645,010 | A | 7/1997 | Lundstrom |
| 6,637,362 | B1 | 10/2003 | Avidiya |

FOREIGN PATENT DOCUMENTS

| | | |
|---|---|---|
| CA | 1138261 | 12/1982 |
| CA | 2466392 | 12/2007 |

*Primary Examiner*—Daniel V Venne
(74) *Attorney, Agent, or Firm*—Antony C. Edwards

(57) ABSTRACT

A sectional boat includes fore and aft boat sections releasably couplable together by a releasable coupler cooperating between the fore and aft boat sections, wherein the releasable coupler comprises at least one dovetail coupler. The dovetail coupler includes at least one female dovetail groove mounted on a first section of the fore and aft boat sections, and a corresponding at least one male dovetail tenon mounted on a second boat section of the fore and aft boat sections. Each tenon is sized to snugly slidably mate into a corresponding female dovetail groove in the first boat section. Each tenon includes a substantially vertically upstanding lug mounted to and extending upwardly from an upper most end of each tenon so as to extend above an upper edge of the first boat section when each tenon is snugly mated in the corresponding female dovetail groove. Each lug includes an aperture. The coupler further includes a ridge member for mating in each aperture so as to releasably lock each tenon in snug mating engagement in the corresponding female dovetail groove.

7 Claims, 6 Drawing Sheets

SECTIONAL BOAT

FIELD OF THE INVENTION

This invention relates to the field of boats having two joinable hull sections, where each section is independently floatable, and in particular to a sectional boat having an improved transom coupler.

BACKGROUND OF THE INVENTION

As described in U.S. Pat. No. 6,637,362 to Avidiya, it is known to form a boat from two or more independent hull sections which are fastened together at their transoms, each section being independently buoyant. See also, for example, U.S. Pat. No. 5,301,629 to Kleyh et al, U.S. Pat. No. 5,261,346 to Updyke, U.S. Pat. No. 4,794,876 to Levine, U.S. Pat. No. 4,718,587 to Roberts, U.S. Pat. No. 4,693,203 to Lewis, and U.S. Pat. No. 4,478,167 to Hart, U.S. Pat. No. 4,366,769 to Lingeman, all of which describe interlocking boat transoms of one form or another. Such hull sections have abutting transoms and the transoms are typically fastened together by fastening members passing through the transoms above and below the waterline.

When such boats are placed into the water, the diverse forces generated by the water acting upon the boat sections try to twist and vertically move the adjacent transoms relative to each other. Such twisting and vertical forces can cause the fastener members to jam, making it difficult to separate the sections, or cause the fastener members to fail.

SUMMARY OF THE INVENTION

In summary, the sectional boat according to the present invention may be characterized in one aspect as including fore and aft boat sections releasably couplable together by a releasable coupler cooperating between the fore and aft boat sections, wherein the releasable coupler comprises at least one dovetail coupler. The dovetail coupler includes at least one female dovetail groove mounted on a first section of the fore and aft boat sections, and a corresponding at least one male dovetail tenon mounted on a second boat section of the fore and aft boat sections.

Each tenon is sized to snugly slidably mate into a corresponding female dovetail groove in the first boat section. Each tenon includes a substantially vertically upstanding lug mounted to and extending upwardly from an upper most end of each tenon so as to extend above an upper edge of the first boat section when each tenon is snugly mated in the corresponding female dovetail groove.

Each lug includes an aperture. The coupler further includes a member for mating in each aperture so as to releasably lock each tenon in snug mating engagement in the corresponding female dovetail groove. In one embodiment a parallel pair of the dovetail couplers are provided.

In one embodiment the member is an elongate rigid member such as a locking bar, pin, or the like, and each aperture is a bore which extends entirely through each lug. Advantageously the member is an elongate member mountable in each aperture so as to journal the member through the bore in snug sliding engagement therein.

In a preferred embodiment the first and second boat sections each have corresponding first and second transoms on which are mounted at least one female dovetail groove and at least one tenon respectively. Further, each bore in each lug is adjacent an upper edge of the first transom when the first and second transoms are mated together by the dovetail coupler.

Advantageously each bore is oriented laterally along the upper edge of the first transom when the tenons are is snugly mated in the female dovetail grooves. The elongate member, when mounted through each bore, lies substantially flush along the upper edge of the first transom when the first and second transoms are mounted together.

The bores in the lugs may be co-axial so that a single elongate rigid member is mountable through each bore.

In a further aspect, each female dovetail groove widens from a narrow upper end of each groove to a wider lower end of each groove, and each corresponding tenon is correspondingly wedge shaped so as to have a narrower upper end and a wider lower end to snugly fit each tenon in each corresponding female dovetail groove. In a further embodiment, the direction of the wedge-shape may be reversed, that is, the top may be wide in the groove and tenon, and the bottom narrower. When each tenon is snugly wedged into each corresponding female dovetail groove in mating engagement by sliding each tenon upwardly into each corresponding female dovetail groove, each tenon is firmly wedged into its corresponding female dovetail groove so as to position the bore in each corresponding lug adjacent the upper edge of the first transom.

The first and second boat sections may be substantially identically shaped so that one of the first and second boat sections may be overlaid on the other so as to snugly fit onto the other of the first and second boat sections for storage and off-water transportation of the boat.

BRIEF DESCRIPTION OF THE DRAWINGS

In the accompanying figures wherein similar characters of reference denote corresponding parts in each view.

DETAILED DESCRIPTION OF EMBODIMENTS OF THE INVENTION

Figure 1A:
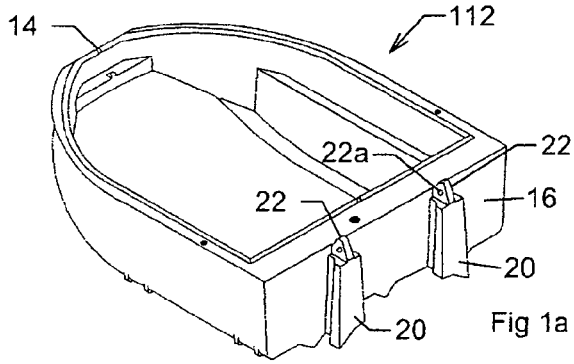
FIG. 1*a* is, in rear perspective view, one sectional boat half having male dovetails mounted to the transom thereof according to one embodiment of the sectional boat according to the present invention.
Figure 1C:
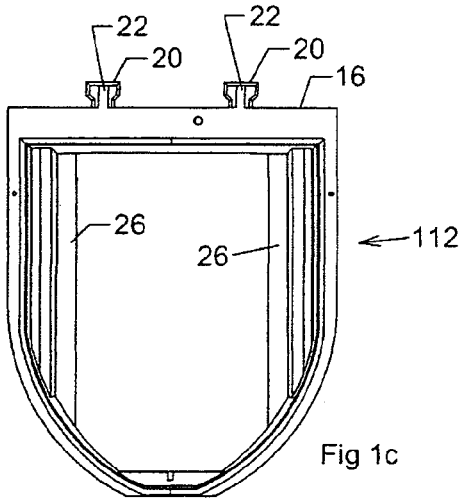
FIG. 1*c* is, in plan view, the sectional boat half of FIG. 1*a*.
Figure 1B:
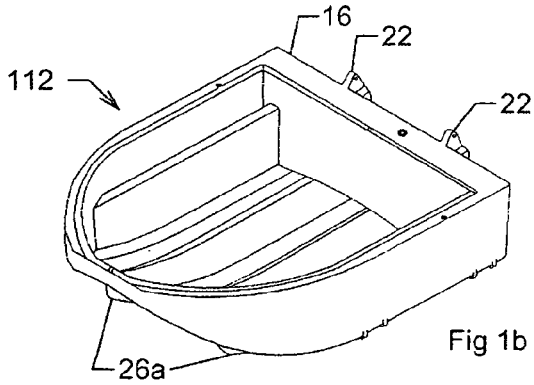
FIG. 1*b* is, in front perspective view, the sectional boat half of FIG. 1*a*.
Figure 1D:
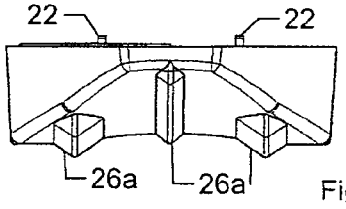
FIG. 1*d* is, in front elevation view, the sectional boat half of FIG. 1*a*.
Figure 1E:
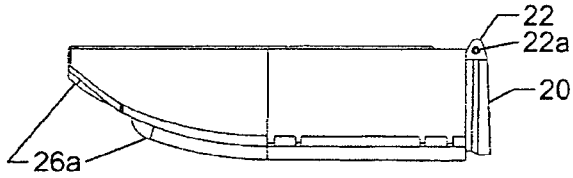
FIG. 1*e* is, in right side elevation view, the left side elevation view being the mirror image thereof, the sectional boat half of FIG. 1*a*.
Figure 2A:
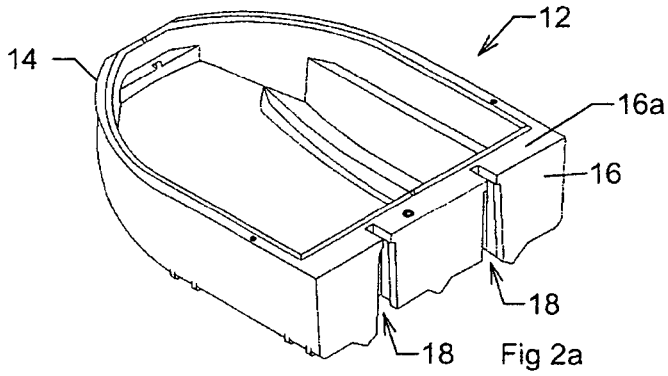
FIG. 2*a* is, in rear perspective view, a second sectional boat half having female dovetail grooves in the transom thereof, according to one embodiment of the sectional boat of the present invention.
Figure 2C:
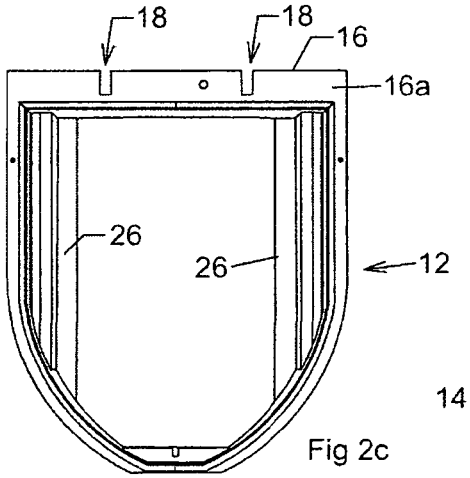
FIG. 2*c* is, in plan view, the sectional boat half of FIG. 2*a*.
Figure 2B:
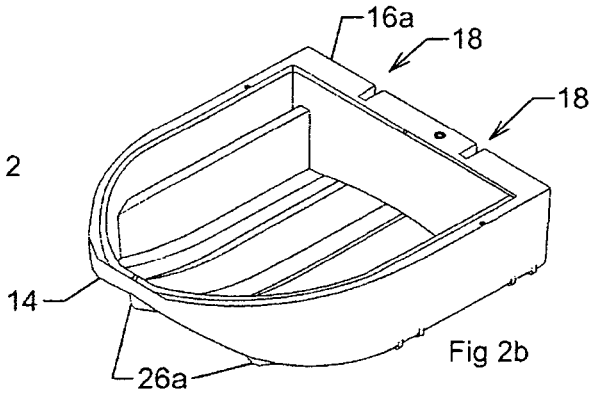
FIG. 2*b* is, in front perspective view, the sectional boat half of FIG. 2*a*.
Figure 2D:
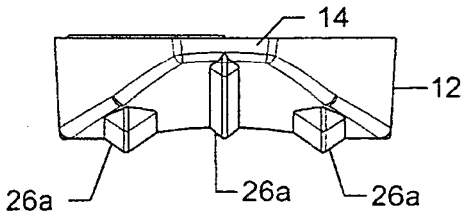
FIG. 2*d* is, in front elevation view, the sectional boat half of FIG. 2*a*.
Figure 2E:
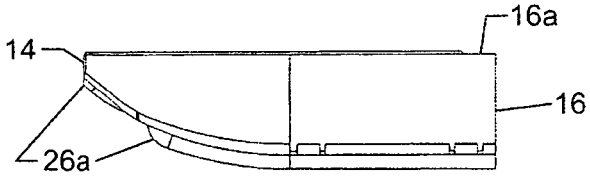
FIG. 2*e* is, in right side elevation view, the left side elevation view being the mirror image thereof, the sectional boat half of FIG. 2*a*.
Figure 3:
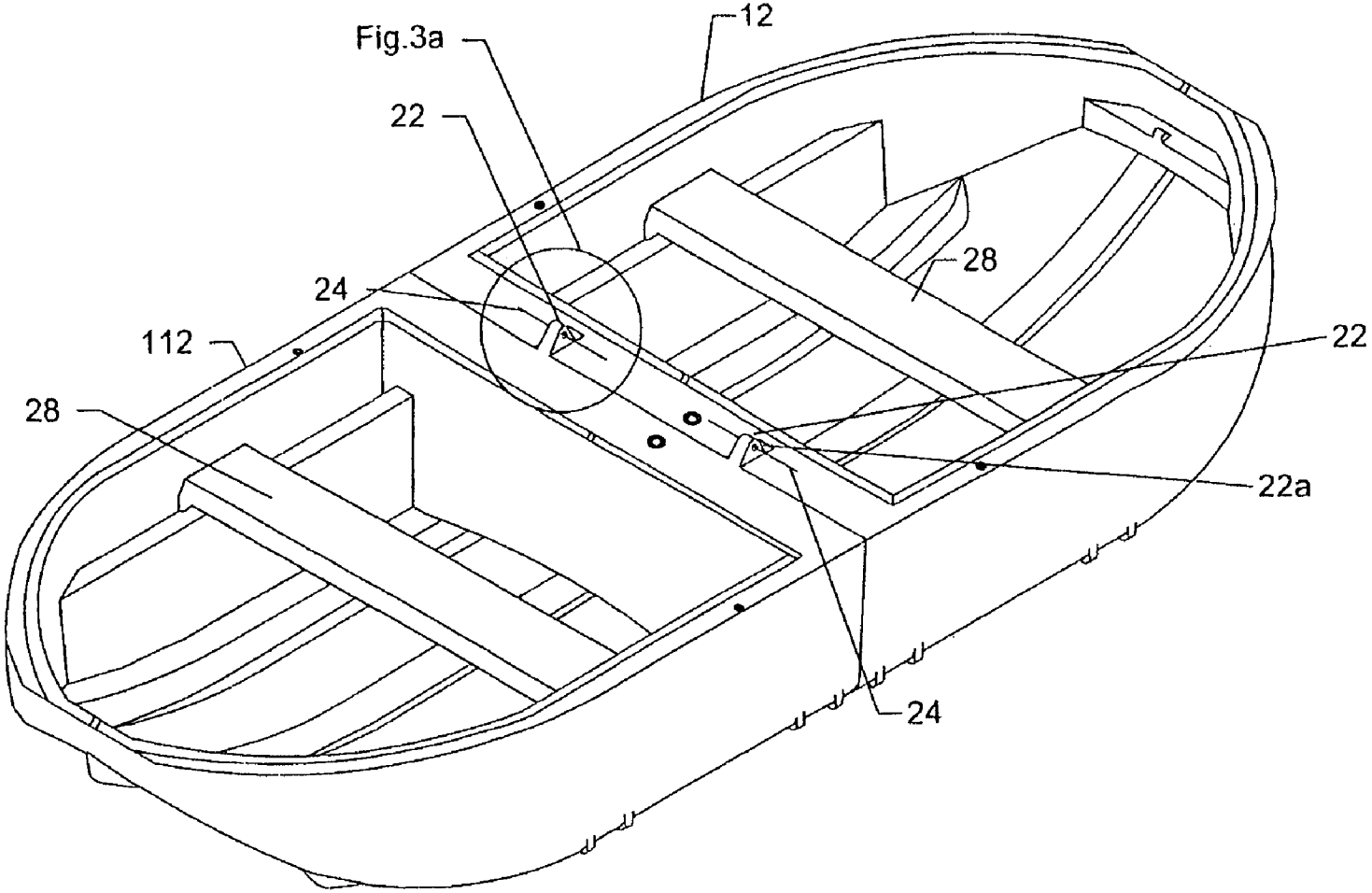
FIG. 3 is, in top perspective view, the assembled sectional boat according to one embodiment of the present invention.
Figure 3A:
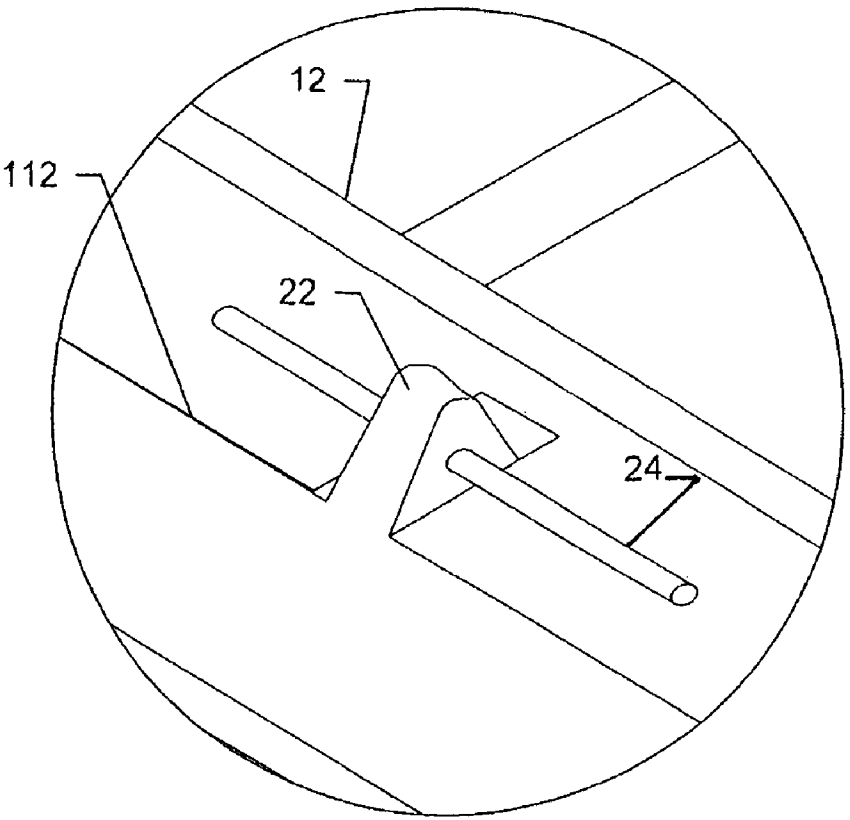
FIG. 3*a* is an enlarged view of a portion of FIG. 3.
Figure 4:
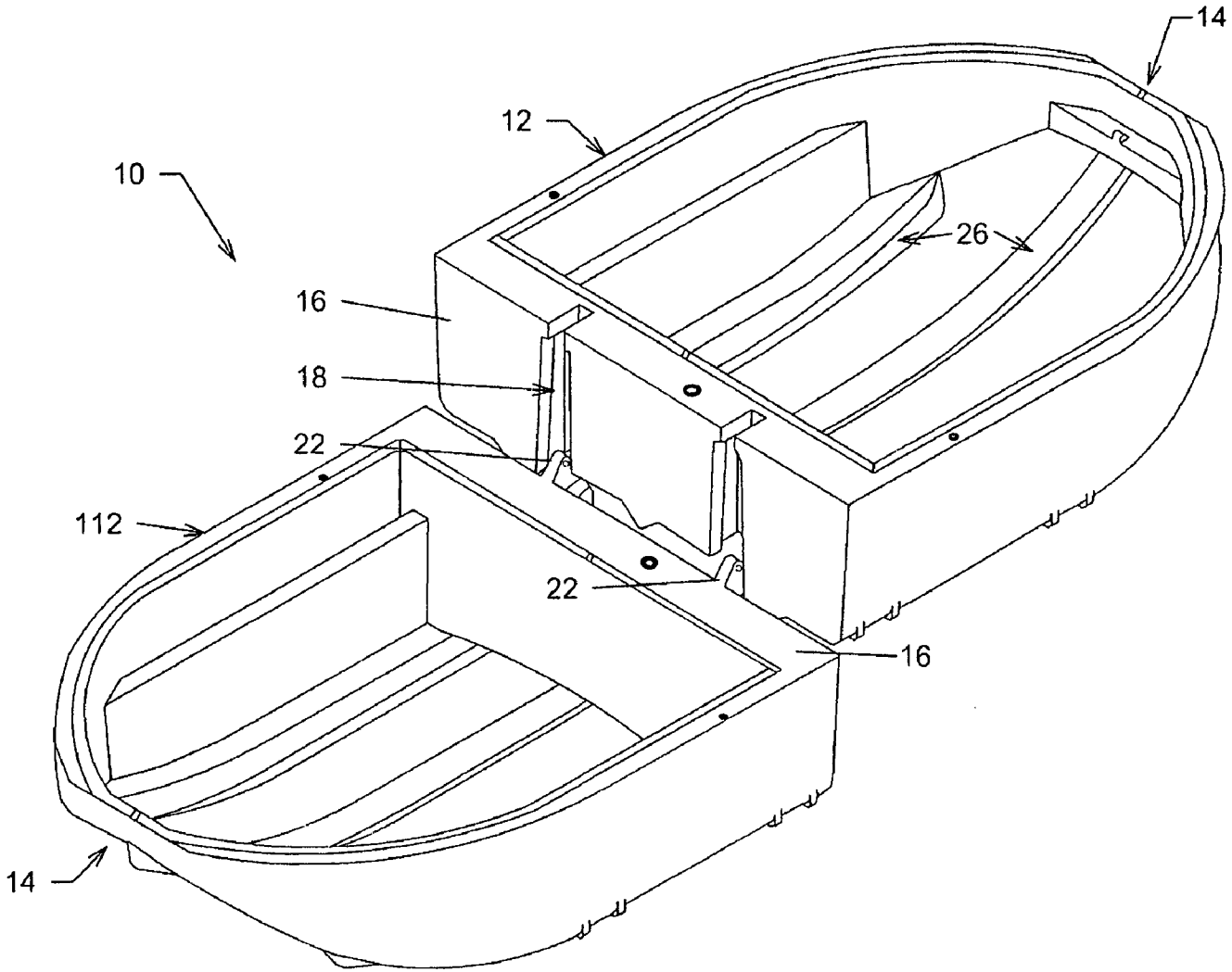
FIG. 4 is, in partially exploded top perspective view, the sectional boat of FIG. 3 with the sectional boat half having female dovetail grooves in its transom aligned adjacent the sectional boat half having male dovetails, so as to align the male dovetails for sliding mating into the dovetail grooves.
Figure 5:
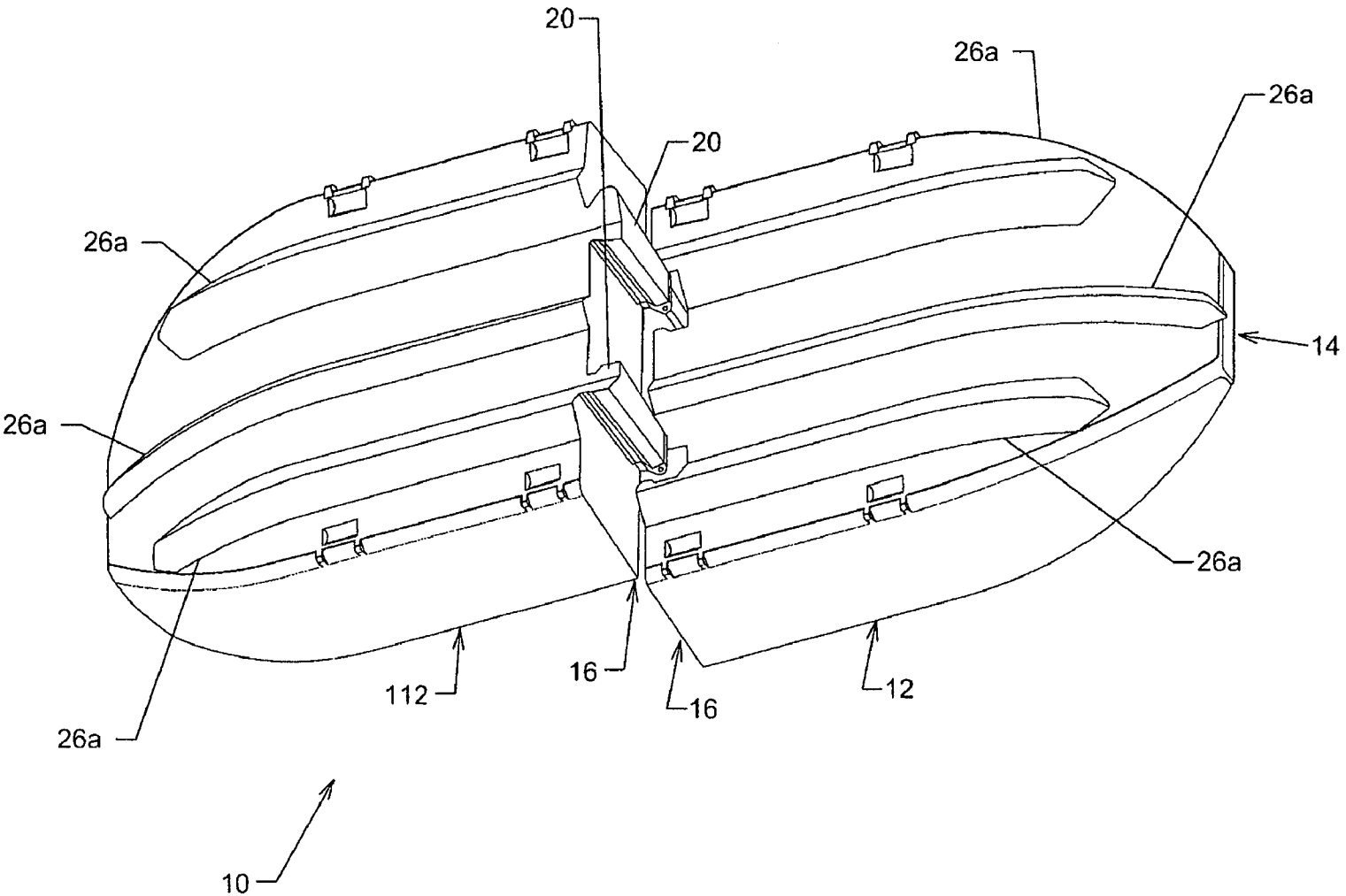
FIG. 5 is, in bottom perspective view, the partially exploded view of the sectional boat of FIG. 4.

The sectional boat 10 of the present invention is formed of a first buoyant hull section 12 and a second buoyant hull section 112. Excluding the transom couplers, hull sections 12 and 112 are substantially identical mirror images of one another. Consequently, parts of second bull section 112 which are identical to parts of first hull section 12 will have the same reference number as the reference number for the same parts of the hull section 12. Thus, hull section 12 has a bow 14 and a transom 16, and hull section 112 has a bow 14 and a transom 16.

A pair of dovetail sockets 18 are formed in transom 16 of hull section 12. A corresponding pair of mail dovetails 20 are attached to or formed as part of transom 16 of hull section 112. The tails 20 are mounted or formed so as to be vertically aligned and parallel with each other. Tails 20 extend the full height of their corresponding transom 16.

The boat halves are interlocked using the two vertical lugs 22 that protrude upwardly from the two male dovetails 20. Each lug 22 has a corresponding aperture 22*a*. A locking bar 24 or pin(s) or the like is passed through apertures 22*a* in lugs 22 to secure the tails 20 in their corresponding mating sockets 18.

The sliding dovetails are assembled by sliding each mail dovetail 20 into its corresponding socket 18 in the opposite transom. The socket is slightly tapered so that the two components can be slid together easily but the joint becomes tighter as the finished position is reached.

As tails 20 are slid upwardly into corresponding dove tail sockets 18 so as to reach their finished position where the sliding dovetails are tightly fitted, lugs 22 protrude above the upper edge 16*a* of the transom 16 of the opposite boat half so that lug apertures 22*a* are just clear of upper edge 16*a*. With lug apertures 22*a* thus clear of upper edge 16*a*, locking bar or pin(s) 24 may be inserted through apertures 22*a* so as to lock lugs 22 into their locked position snugly above transom 16 thereby locking tails 20 tightly into sockets 18. With hull sections 12 and 112 thereby inter locked, movement between the two hull sections is prevented even when boat 10 is used in rough water.

The hull sections may have longitudinally extending parallel spaced-apart channels 26 for increased rigidity. Channels 26 form runners or strakes 26*a* along the undersides of the hull sections.

Advantageously, hull sections 12 and 112 are substantially identical in plan form dimensions, and also in side elevation dimensions so that in a storage or transportation mode, one of the hull sections may be mounted atop of the other hull section. This reduces the size of boat 10 to one-half of its plan form size for example for ease of transportation when mounted atop a vehicle or trailer and also provides for secure and weather resistant storage for equipment contained within the boat when in its storage and transportation mode.

Seats 28 may be provided which are selectively positionable within the hull. Flotation, for example by foam injection (not shown) is provided within cavities within the hull. It is specifically intended that the present invention be adapted for use with boats having longer or smaller dimensions including longer or smaller length and width, as would be known to one skilled in the art.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. A sectional boat comprising:

fore and aft boat sections releasably couplable together by a releasable coupler cooperating between the fore and aft boat sections, wherein said releasable coupler comprises at least one dovetail coupler having at least one female dovetail groove mounted on a first section of said fore and aft boat sections, and a corresponding at least one male dovetail tenon mounted on a second boat section of said fore and aft boat sections wherein each said tenon is sized to snugly slidably mate into a corresponding said female dovetail groove in said first boat section, wherein each said tenon includes a substantially vertically upstanding lug mounted to and extending upwardly from an upper most end of each said tenon so as to extend above an upper edge of said first boat section when each said tenon is snugly mated in said corresponding female dovetail groove, wherein each said lug includes an aperture, and wherein said coupler further comprises a member for mating in each said aperture so as to releasably lock each said tenon in said snug mating engagement in said corresponding female dovetail groove.

2. The boat of claim 1 wherein said at least one dovetail coupler includes at least a pair of said dovetail couplers.

3. The boat of claim 1 wherein said member is an elongate rigid member, and wherein each said aperture is a bore which extends entirely through each said lug, and wherein said member is an elongate member mountable in each said aperture so as to journal said member through said bore in snug sliding engagement therein.

4. The boat of claim 3 wherein said first and second boat sections have corresponding first and second transoms on which are mounted said at least one female dovetail groove and said at least one tenon respectively, and wherein each said bore in each said lug is adjacent an upper edge of said first transom when said first and second transoms are mated together by said at least one dovetail coupler, and wherein each said bore is oriented laterally along said upper edge of said first transom when said at least one tenon is snugly mated in said at least one female dovetail groove, and wherein said elongate member when mounted through each said bore lies substantially flush along said upper edge of said first transom when said first and second transoms are mounted together.

5. The boat of claim 4 wherein said at least one female dovetail groove is a substantially parallel pair of female dovetail grooves and wherein corresponding said at least one tenon each has one of said lugs mounted thereon, and wherein corresponding said bores in said lugs are co-axial so that a single said elongate rigid member is mountable through each said bore.

6. The boat of claim 5 wherein each said female dovetail groove widens from a narrow upper end of each said groove to a wider lower end of each said groove, and wherein each corresponding said tenon is correspondingly wedge shaped so as to have a narrower upper end and a wider lower end to snugly fit each said tenon in each corresponding said female dovetail groove, wherein when each said tenon is snugly wedged into each said corresponding female dovetail groove in said mating engagement by sliding each said tenon upwardly into each corresponding said female dovetail groove, each said tenon is firmly wedged into its corresponding said female dovetail groove so as to position said bore in each said corresponding lug said adjacent said upper edge of said first transom.

7. The boat of claim 6 wherein said first and second boat sections are substantially identically shaped so that one of said first and second boat sections may be overlaid on the other so as to snugly fit onto the other of said first and second boat sections for storage and off-water transportation.

* * * * *